US005755322A

United States Patent [19]

Yang

[11] Patent Number: 5,755,322

[45] Date of Patent: May 26, 1998

[54] CLUB SPACER ASSEMBLY FOR A GOLF CLUB BAG

[76] Inventor: Yung-Fang Yang, No. 1, Lane 14, Chung-Hsing St., An-Ping Dist., Tainan, Taiwan

[21] Appl. No.: 691,683

[22] Filed: Aug. 2, 1996

[51] Int. Cl.[6] ..... A63B 55/00

[52] U.S. Cl. ..... 206/315.2; 206/315.6; 211/70.2

[58] Field of Search ..... 206/315.3–315.6, 206/315.2; 211/70.2

[56] References Cited

U.S. PATENT DOCUMENTS

| | | | |
|---|---|---|---|
| D. 384,503 | 10/1997 | Kyrwood | D3/320 |
| 1,756,902 | 4/1930 | Boyce | 206/315.6 |
| 2,436,687 | 2/1948 | Corbett | 206/315.6 |
| 2,763,309 | 9/1956 | Jones | 206/315.6 |
| 3,503,518 | 3/1970 | Black | 206/315.6 X |
| 3,667,078 | 6/1972 | Distasio | 206/315.6 X |
| 4,194,547 | 3/1980 | Sidor et al. | 206/315.6 |
| 4,960,212 | 10/1990 | Wu | 211/70.2 |
| 5,029,703 | 7/1991 | Dulyea, Sr. | 206/315.6 X |
| 5,383,555 | 1/1995 | Weinmeier | 206/315.6 |
| 5,511,660 | 4/1996 | Yamada et al. | 206/315.6 |
| 5,544,743 | 8/1996 | Hong | 206/315.6 X |

FOREIGN PATENT DOCUMENTS

| | | | |
|---|---|---|---|
| 280427 | 11/1927 | United Kingdom | 206/315.5 |
| 414168 | 8/1934 | United Kingdom | 206/315.5 |
| 438747 | 11/1935 | United Kingdom | 206/315.5 |

*Primary Examiner*—Sue A. Weaver

*Attorney, Agent, or Firm*—Morton J. Rosenberg; David I. Klein; Jun Y. Lee

[57] ABSTRACT

The present invention relates to a yoke of a golf club bag which comprises three brackets connecting together and mounting on an opening of a golf club bag. The yoke is presented in a high, a middle and a low attitude of the brackets with varied retaining spaces, in which the middle retainers of the brackets are defined by several slanting paralleled diaphragms for locating the heads of iron and brassy putters respectively, whereas the high retainer of the bracket is a sleeve barrel and is provided for the shaft of the wood driver jamming in and the head bridging over the opening of the sleeve.

1 Claim, 5 Drawing Sheets

CLUB SPACER ASSEMBLY FOR A GOLF CLUB BAG

BACKGROUND OF THE INVENTION

The present invention relates to a yoke of a golf club bag, and more particularly to a club spacer assembly securing to the flange of an opening of the golf bag comprising various types of brackets for position of golf clubs orderly.

Golf bags have been developed for a long time for the convenience of golfers to carry their clubs. The bags are normally loaded with various clubs, each functions differently, such as digging or pushing, etc. . . . But the clubs in a golf bag bump each other when carried that may even damage the clubs. In addition, owing to a various types of clubs mixing in one bag, the golfer may have difficulty to pick up a correct one that he wants to use. Therefore, a yoke to be mounted on the golf club bag is developed which can locate each club in a fixed position in the bag to eliminate the collision of the clubs, and further is easy to pick up an appropriate club.

The conventional golf bag, as shown in FIG. 4, includes a yoke which is shaped like a reversed English letter U, having a plurality of V-shaped retainers A on the top portion, and two clamp holders B and C at respective sides extending downwardly. Each of the clamp holders B and C has a clamping slot B1 or C1 at the lower end which are adjustable by a pair of bolts D. One clamp holder B is slidably connected with the yoke for adjusting the distance of the both clamp holders B and C. In mounting, referring to FIG. 5, the clamping slots B1, C1 are secured to the edge of the bag E at opposite sides which makes the yoke bridge over the mouth for inserting clubs in the bag with the club heads clamped in each retainer A to locate the position.

In accordance with above-mentioned conventional golf-club bag, the yoke mounted on the opening of the bag with two clamp holders B and C can not provide a stable state. Additionally, the retainers A are formed in identical shapes which do not fit the clubs that have different sizes and lengths.

OBJECTS AND SUMMARY OF THE INVENTION

A main object of the present invention is to provide a golf-club yoke which can stand on the opening of the bag stably and fit clubs with various sizes and lengths (about three kinds.)

The present invention is composed of three different brackets connecting together in swing joint for adjusting to fit clubs with varied size of bag. The bottom portions of the three brackets extend down with several joiners for catching the edge of the bag and the internal struts firmly. The height of the three brackets and the shape of the retainers are different to fit with varied clubs.

DETAILED DESCRIPTION OF PREFERRED EMBODIMENTS

Figure 1:
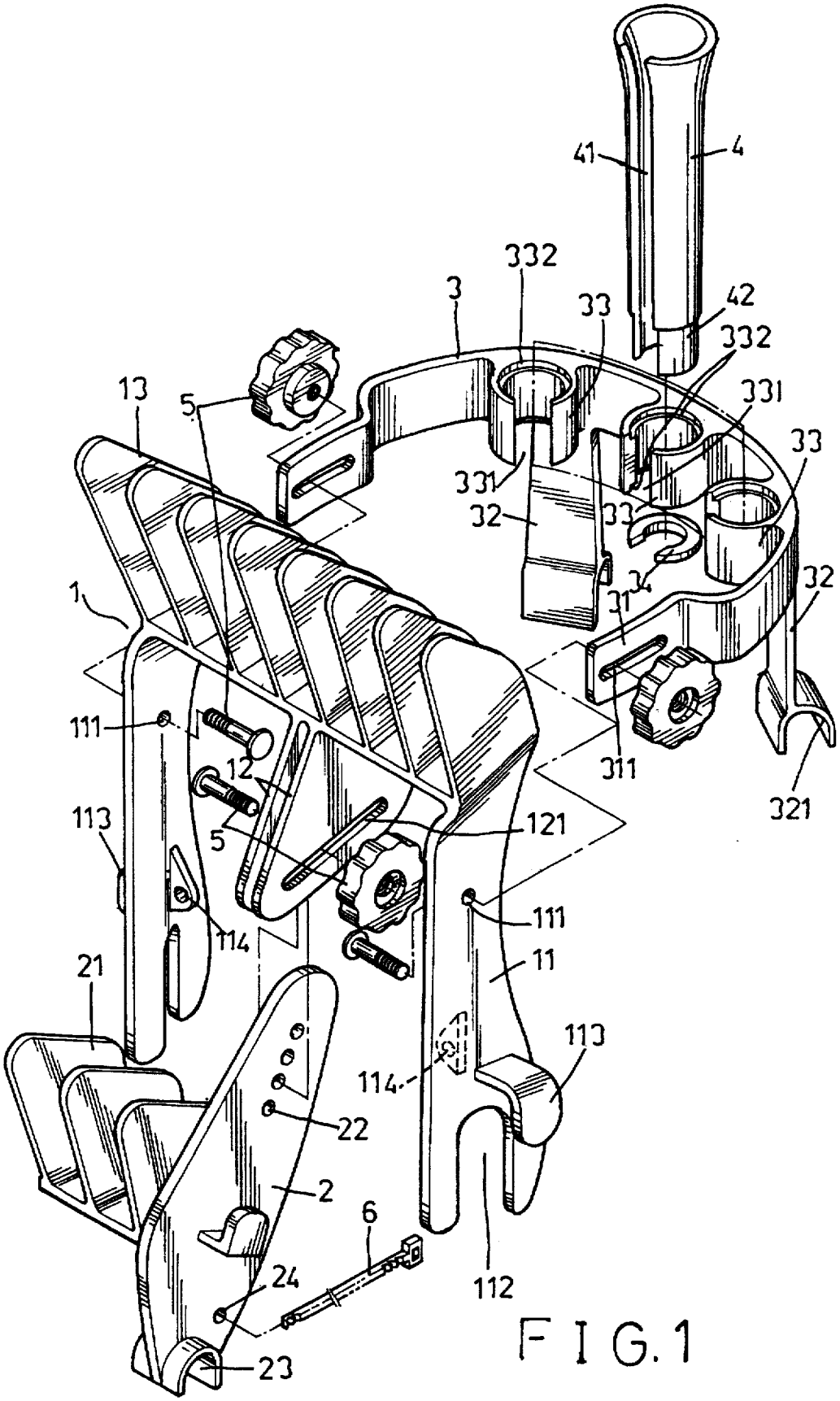
FIG. 1 is an exploded view of a yoke of the present invention.

Referring to FIG. 1, the present invention comprises an arch bracket 1, a plate bracket 2 and a semicircular bracket 3 having plural sleeve barrels 4 inserted therein.

The arch bracket 1 includes a plural equidistant diaphragms 13 on the top side, two bracket arms 11 each has a through-hole 111, an opening 112 at the low end of the bracket arms 11 facing downwardly adapted to catch a strut 71 in the opening of the bag 7. A pair of hooks 113 are formed on the outer portion immediately above the opening 112 of the arms 11 and a pair of lugs 114 are formed on the inner portion opposite the hooks 113. A pair of clamp plates 12 are formed at center bottom portion of the bracket 1, each of which has a guide slot 121 thereat.

The plate bracket 2 is composed essentially of a vertical plate, a horizontal plate secured on one side thereof. The horizontal plate includes a plural equidistant diaphragms 21 extending upwardly for locating the heads of the clubs. The vertical plate has a plural through-holes 22 which are adapted to secure the vertical plate in the clamp plates 12 with fasteners 5. The vertical plate further comprises an arc strap 23 at the bottom end with its opening facing downwardly for seating on the edge of the pocket and a hole 24 on one side of the wall for insertion of a rigging 6 therein. The semicircular bracket 3, according to the figure, includes two straps 31 at respective ends with a slot 311 for overlapping with the through-hole 111 on the bracket arm 11 of the arch bracket 1 and secured by fasteners 5. Two stabilizers 32 extend downwardly from the bottom side of the semicircle bracket, each of which having an arc strap 321 with its opening facing downward for seating on the edge of the bag. A plurality of connecting rings 33 are formed on the inner wall of the bracket 3, each has a slotted opening 331 and two step-like interfaces 332 formed along the inner upper and the lower flanges, and two elastic C retainer rings 34.

The sleeve barrel 4 is a horn sleeve having an axial opening slot 41 and a reduced diameter section 42 at the bottom end for inserting into the connection ring 33 of the circular bracket 3 to construct a holder of the club.

Figure 2:
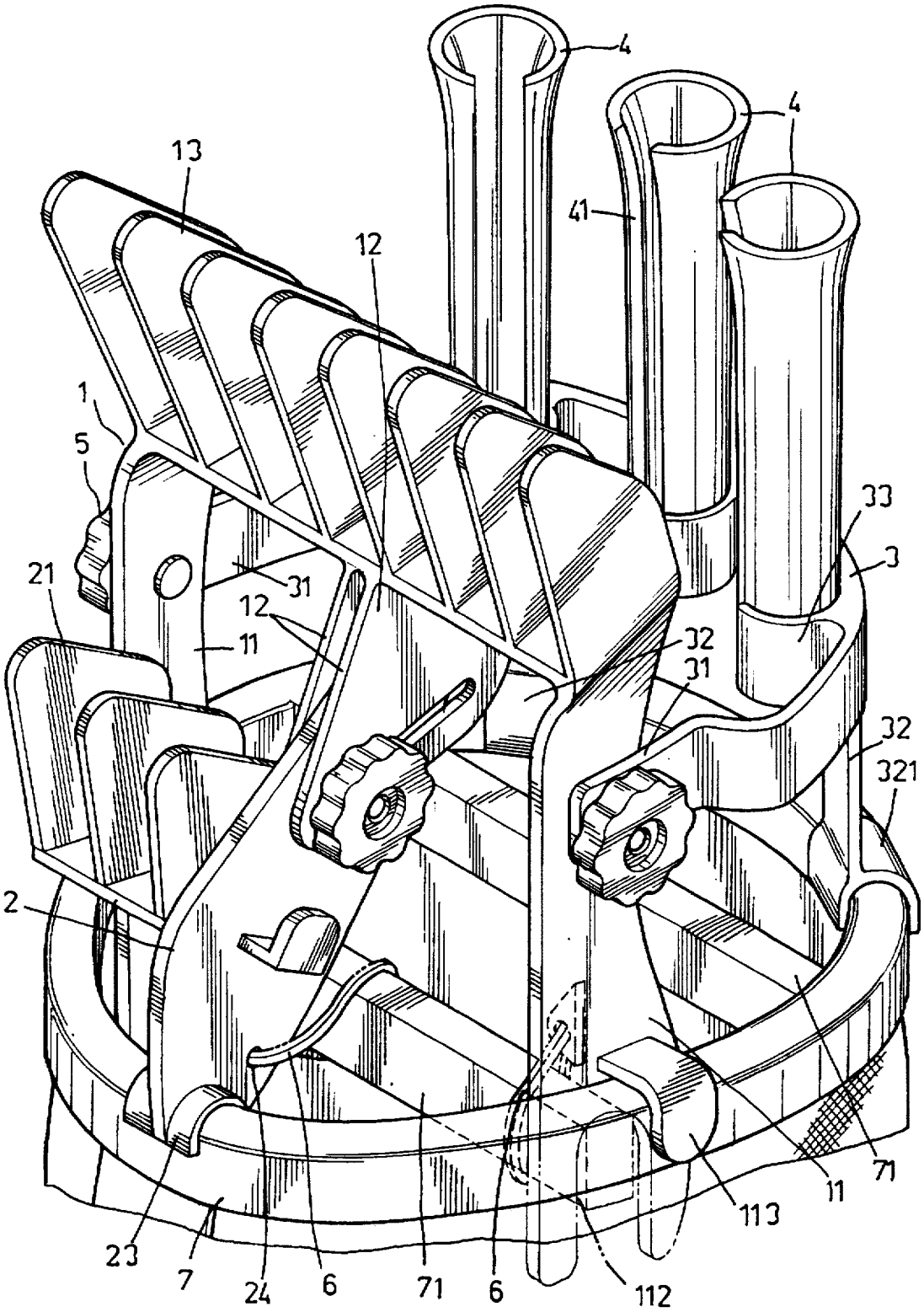
FIG. 2 is a perspective view of FIG. 1.

In assembling, when the bracket assembly is mounted on the opening of the bag 7, as shown in FIG. 2, the openings 112, are seating on a strut 71 while the hooks 113 and the arc straps 23 and 321 are seating on the flange of the bag that constructs a five setting-point supporting one assembly. Then insert two riggings 6 passing through the lugs 114 on the inside wall of the bracket arms 11 and the hole 24 at bottom side of the plate bracket 2 to tie the strut 71 of the opening of the bag 7 securely. This makes the yoke securely attached to the bag 7.

Figure 3:
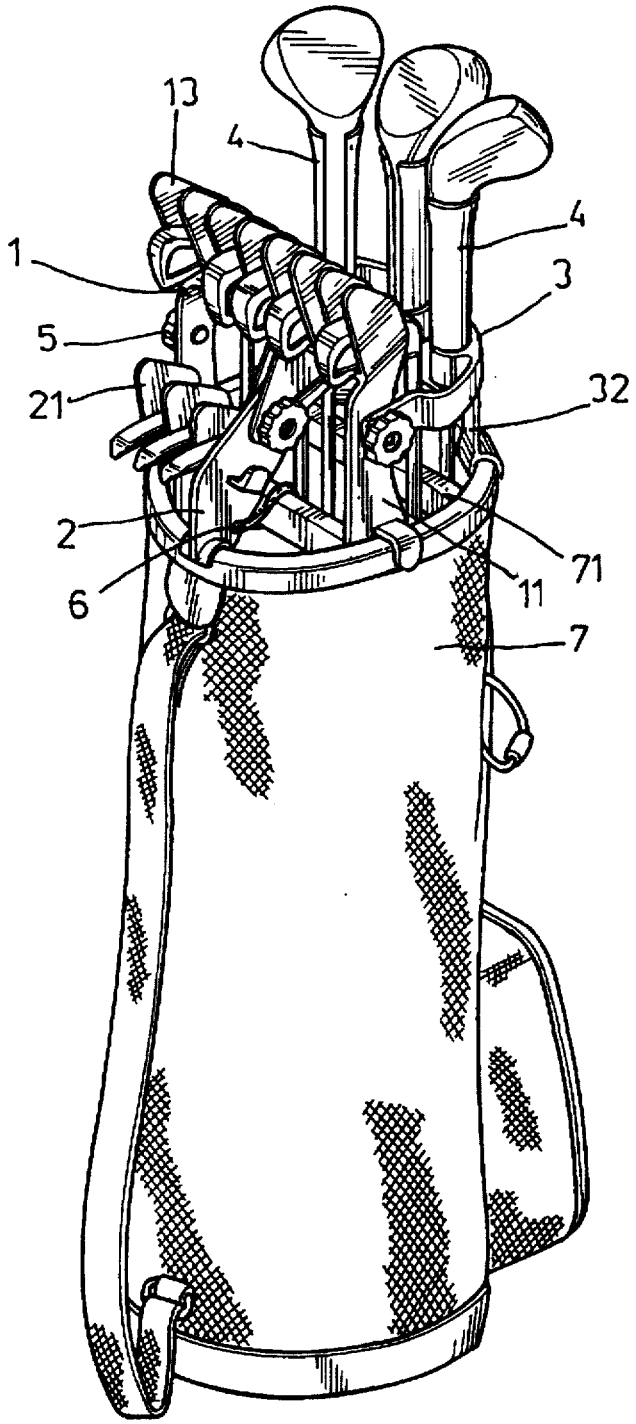
FIG. 3 is a perspective view showing an operation of the present invention.
Figure 4:
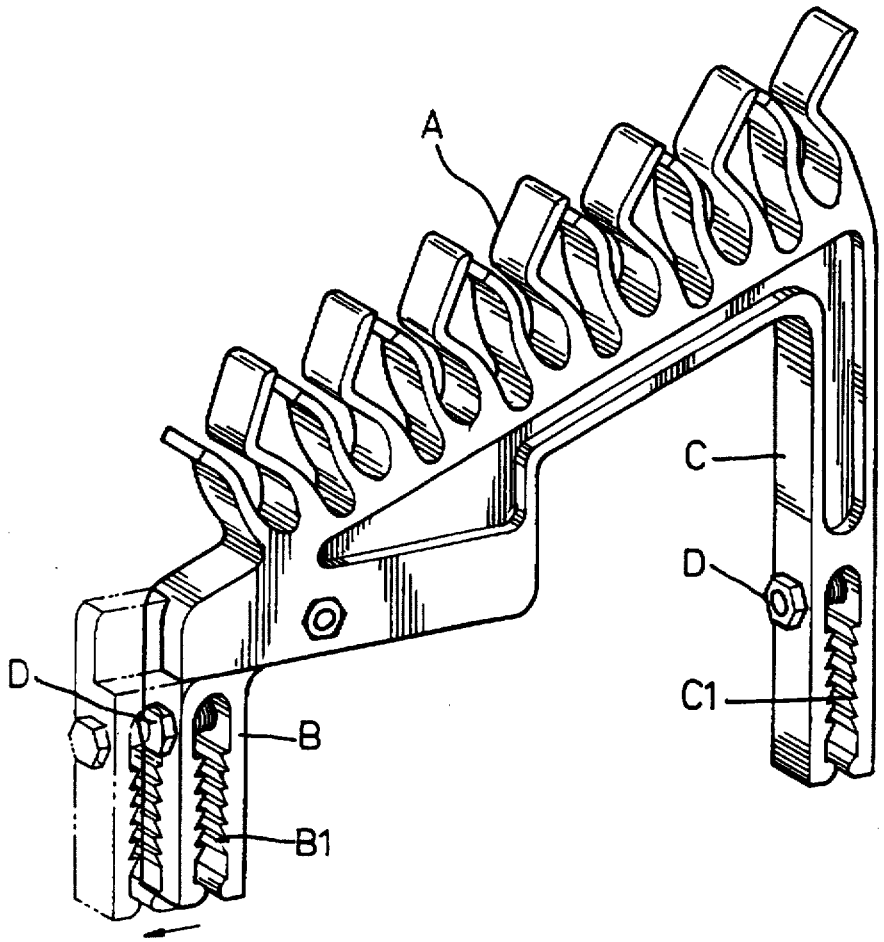
FIG. 4 (PRIOR ART)
FIG. 4 is a perspective view of a prior art yoke of conventional.
Figure 5:
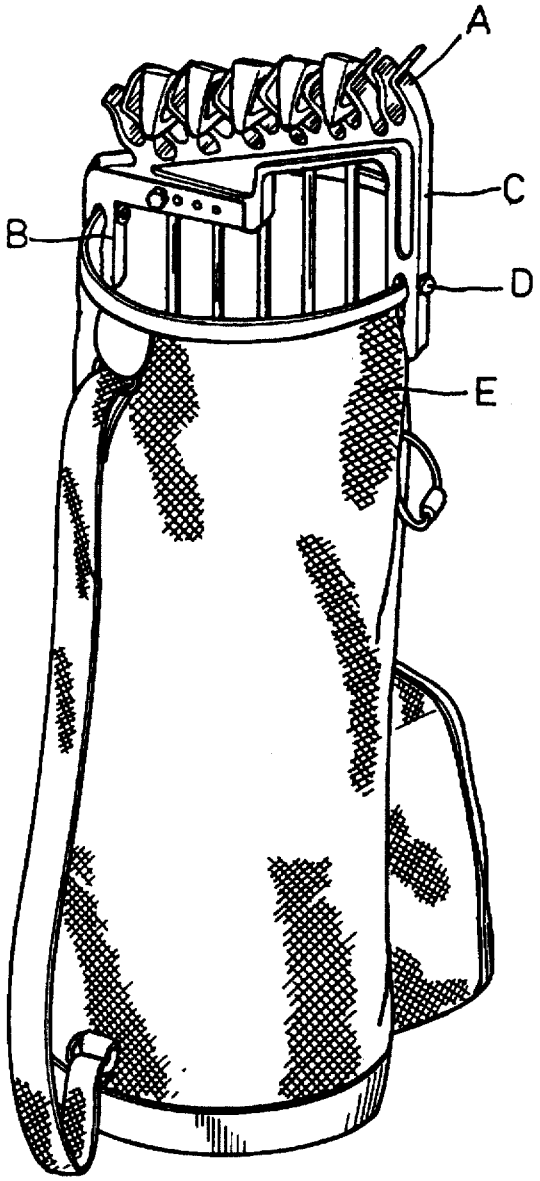
FIG. 5 (PRIOR ART)
FIG. 5 is a perspective view showing an operation of FIG. 4.

In practicing, as showing in FIG. 3, the plural retaining spaces defined by the diaphragms 13 of the arch bracket 1 are provided for heads of the iron putters to seat whilst the spaces defined by the diaphrams 21 of the plate bracket 2 is provided for the head of brassy putters to seat therein, and connecting rings 33 are for the wood driver heads to seat therein.

I claim:

1. A club spacer assembly removably securable to a flange of a golf club bag, comprising:

an arch bracket having two opposing sides and a top portion extending therebetween, said sides of said arch bracket being formed by a pair of spaced bracket arms extending from a respective side of said top portion, each said bracket arm including a hook extending from an outer wall thereof for engaging respective portions of the golf club bag flange, each bracket arm having a through hole formed therein above said hook, said top portion having a plurality of equidistantly spaced first diaphragms extending upwardly therefrom, said top portion having a pair of centrally located clamp plates disposed in spaced relationship and extending downwardly therefrom, each of said pair of clamp plates having a guide slot formed therethrough;

a plate bracket including a vertical plate disposed between said pair of clamp plates and a horizontal plate extending from one side of said vertical plate, said vertical plate having an arch strap formed at a bottom end thereof for engaging a portion of the golf club bag flange and at least one through hole formed therein adjacent an opposing upper end of said vertical plate in aligned relationship with said guide slots for passage of a fastener therethrough, said horizontal plate having a plurality of equidistantly spaced second diaphragms extending upwardly therefrom;

a semicircular bracket having a pair of connection straps formed on opposing ends thereof for respective coupling to said pair of bracket arms, each of said connection straps having a slot formed therethrough disposed in aligned relationship with said through hole of a respective bracket arm, said semicircular bracket having at least one stabilizer extending from a bottom portion thereof and having an arch strap formed on an end thereof for engaging a portion of the golf club bag flange, said semicircular bracket having at least one connecting ring disposed on an inner wall thereof, said at least one connecting ring having a slotted opening formed through a wall thereof and extending between upper and lower edges of said connecting ring, said at least one connecting ring having a pair of step-like interfaces respectively formed in said upper and lower edges thereof;

at least one elastic C-shaped retainer ring disposed in one of said pair of step-like interfaces; and, at least one longitudinally extended sleeve barrel disposed in said at least one connecting ring for holding a golf club, said at least one sleeve barrel having a slotted opening extending between opposing longitudinal ends thereof and a reduced diameter portion formed on one of said ends of said sleeve barrel for engagement within said at least one connecting ring.

* * * * *